US011213136B2

(12) United States Patent
Chang

(10) Patent No.: US 11,213,136 B2
(45) Date of Patent: Jan. 4, 2022

(54) HALF-SITTING STOOL WITH SUPPORTED SIT BONE

(71) Applicant: Steven Chang, Stillwater, MN (US)

(72) Inventor: Steven Chang, Stillwater, MN (US)

( * ) Notice: Subject to any disclaimer, the term of this patent is extended or adjusted under 35 U.S.C. 154(b) by 0 days.

(21) Appl. No.: 16/826,116

(22) Filed: Mar. 20, 2020

(65) Prior Publication Data

US 2020/0297120 A1 Sep. 24, 2020

Related U.S. Application Data

(60) Provisional application No. 62/822,813, filed on Mar. 23, 2019.

(51) Int. Cl.

| | |
|---|---|
| ***A47C 9/02*** | (2006.01) |
| ***A47C 1/00*** | (2006.01) |
| ***A47C 3/00*** | (2006.01) |
| ***A47C 3/20*** | (2006.01) |
| ***A47C 3/40*** | (2006.01) |
| ***A47C 7/50*** | (2006.01) |
| ***A47C 7/02*** | (2006.01) |
| ***A47C 9/00*** | (2006.01) |

(52) U.S. Cl.
CPC ..... *A47C 9/025* (2013.01); *A47C 7/029* (2018.08); *A47C 9/002* (2013.01)

(58) Field of Classification Search
CPC ..... A47C 7/029; A47C 9/002; A47C 9/029
USPC ..... 297/195.11, 461
See application file for complete search history.

(56) References Cited

U.S. PATENT DOCUMENTS 1,478,567 A * 12/1923 Howard ..... A47C 3/18 248/415
2,620,863 A * 12/1952 Cooper ..... A61B 90/60 297/461 X
3,312,987 A * 4/1967 Emery ..... A47G 9/1054 5/644
3,477,673 A * 11/1969 Bereday ..... A47C 9/025 248/121
3,511,533 A * 5/1970 Drabert ..... A47C 9/025 297/337
4,451,086 A * 5/1984 Seven ..... A47C 7/024 297/312
4,632,410 A * 12/1986 Bainbridge ..... B25H 3/00 280/32.5
4,803,945 A * 2/1989 Adams ..... B63B 29/04 114/363
5,149,174 A * 9/1992 Charash ..... A47C 9/005 248/125.1
5,186,519 A * 2/1993 Larson ..... A47C 9/005 297/338
5,199,763 A * 4/1993 Wilder ..... A47C 9/025 297/15
5,303,981 A * 4/1994 Wilder ..... A47C 9/025 297/14
5,330,254 A * 7/1994 Larson ..... A47C 9/005 297/338

(Continued)

*Primary Examiner* — Rodney B White
(74) *Attorney, Agent, or Firm* — Dykema Gossett PLLC

(57) ABSTRACT

A seating apparatus for supporting a portion of a user, the seating apparatus comprising a reorientable seat portion including a seat platform and a cutout, wherein the seat selectively underlies a first ischial tuberosity of the user but not the second ischial tuberosity, the selection of which is determined by the orientation of the reorientable seat portion.

18 Claims, 5 Drawing Sheets

(56) References Cited

U.S. PATENT DOCUMENTS 5,374,109 A * 12/1994 Wortman ..... A47C 9/002 297/423.41
5,435,623 A * 7/1995 Kapec ..... A61G 5/14 297/339
5,630,648 A * 5/1997 Allard ..... A47C 9/025 297/327
5,873,628 A * 2/1999 Allard ..... A47C 9/025 297/326
5,988,739 A * 11/1999 Dodge ..... B62J 1/002 297/195.1
6,045,180 A * 4/2000 Clutton ..... B62J 1/002 297/202
6,224,154 B1 * 5/2001 Stoki ..... A61B 90/60 297/338
6,702,384 B1 * 3/2004 Brown ..... A47C 3/38 297/195.11 X
6,709,052 B2 * 3/2004 Jalkanen ..... A47C 9/025 297/461 X
6,824,149 B1 * 11/2004 Whitlock ..... B25H 5/00 280/32.6
7,293,825 B2 * 11/2007 Vergara ..... A47C 9/002 297/1
7,350,863 B2 * 4/2008 Engels ..... A47C 9/025 297/284.11
7,387,339 B2 * 6/2008 Bykov ..... A47C 7/14 297/312
7,726,729 B2 * 6/2010 Groll ..... A47C 9/025 297/4
8,220,872 B2 * 7/2012 Hong ..... A47C 3/30 297/461 X
9,474,377 B2 * 10/2016 Keen ..... A47C 9/022
9,827,162 B1 * 11/2017 Vidmar ..... A47C 7/006
9,883,748 B2 * 2/2018 Murray ..... A47C 7/004
9,968,195 B2 * 5/2018 Sheinkop ..... A47C 7/002
10,376,071 B2 * 8/2019 Patton ..... F16C 11/04
10,583,030 B2 * 3/2020 Mattson ..... A61F 5/56
2003/0168899 A1 * 9/2003 Voyce, IV ..... A47C 16/04 297/195.11 X
2005/0088029 A1 * 4/2005 Stokes ..... A47C 9/022 297/461
2015/0173515 A1 * 6/2015 Freedman ..... A47C 7/405 297/314

* cited by examiner

FIG. 1
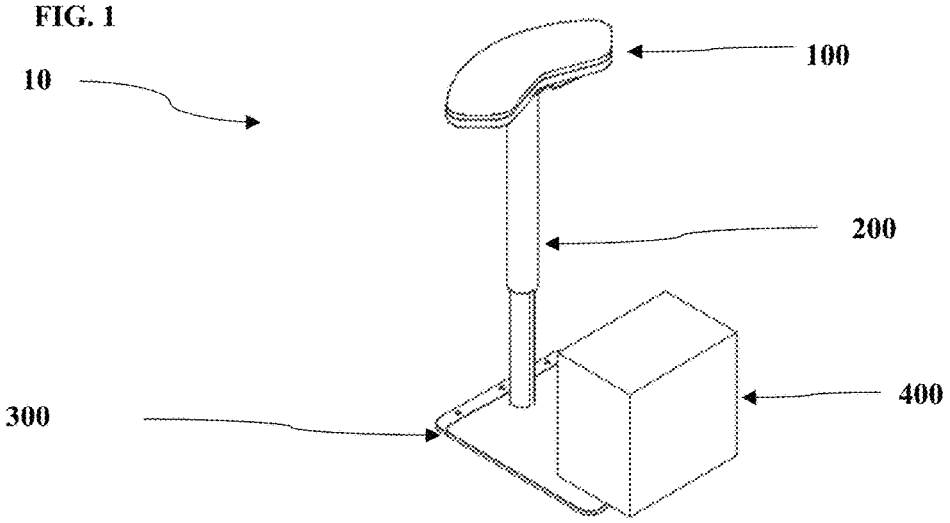
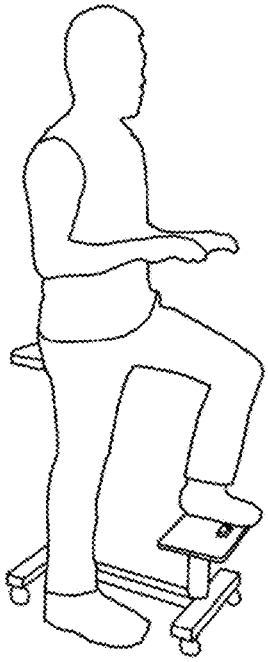
FIG. 2A
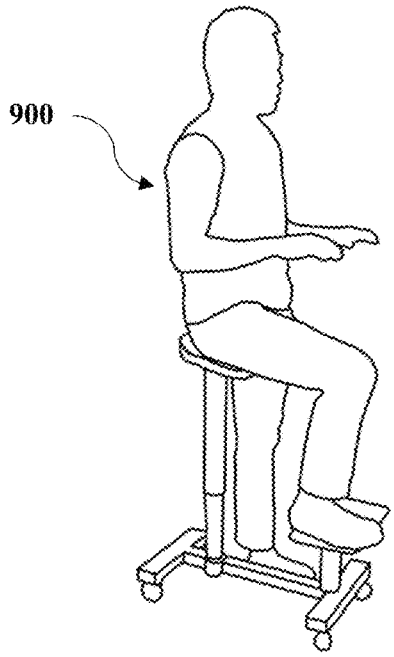
FIG. 2B
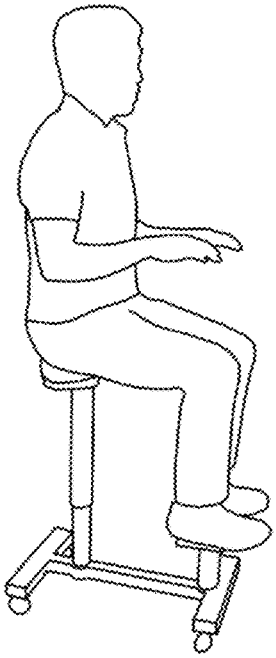
FIG. 2C

HALF-SITTING STOOL WITH SUPPORTED SIT BONE

CROSS-REFERENCE TO RELATED APPLICATIONS

This application claims priority to U.S. provisional application 62/822,813 filed on 23 Mar. 2019, which is incorporated by reference as if set forth fully herein.

FIELD

The present disclosure relates to chairs, stools, sitting devices, standing devices, leaning devices and body-support devices. In particular, the present disclosure relates to a piece of furniture that serves as a substitute to office chairs, task chairs, stools, leaning chairs, perching chairs, and hybrids of such.

BACKGROUND

Well-designed sitting devices that account for ergonomic factors should promote good posture to minimize strain in the neck and back and should allow for periodic adjustments in the user's position to redistribute stresses, relieve pressure points, and allow blood flow through areas where blood flow has been constricted.

Good posture can be generally defined as posture in which the spine maintains neutral curvature, with normal lordotic ("inward") curvature of the cervical and lumbar spine and normal kyphotic ("outward") curvature of the thoracic spine. Deviation from neutral curvature, as occurs when one is slumping, creates an aesthetically unappealing appearance and causes shear stresses between vertebra. Shear stresses are increased as deviation is increased, or as load is increased. Shear stresses can trigger pain in people sensitive to such stresses, especially in those who have had previous spinal injuries. Lower back pain, for example, is a common cause of missed workdays in the United States.

Maintaining a neutral lumbar spine requires the least effort in the core muscles when a thigh is at an angle close to 180 degrees relative to the back (e.g. when standing). For this reason, posture is often better when a person is standing than when he or she is sitting. However, standing requires muscular effort to keep the leg extended and to balance the body (since bipedal standing is not inherently stable). To reduce the effort required when stationary, numerous devices are used, such as chairs. But chairs put the thighs at an angle less than 180 degrees (often approximately 90 degrees) in relation to the back, causing a flexion force in the lumbar spine, the flexion force increasing with decreasing back-thigh angle. Unwanted flexion can be counteracted by using the core muscles to maintain normal lordosis of the lumbar spine; such use of core muscles is present when one is, for example, "sitting up straight". However, prolonged exertion of core muscles can cause fatigue, which hinders the person's ability to continue maintaining good posture.

Many devices are available that attempt to improve sitting posture or to reduce time spent sitting.

Lumbar-support devices apply an external force to the lumbar spine to counteract the flexion force caused by sitting.

Reclining chairs increase back-thigh angle by reclining the back while maintaining the thighs in a horizontal position. They are often accompanied by lumbar-support devices.

Saddle chairs, kneeling chairs, and perching stools increase back-thigh angle by positioning the thighs at a downward angle while allowing the upper body and back to remain vertical, reducing the core-muscle effort required to maintain a neutral spine. They are usually not accompanied by lumbar-support devices.

Leaning chairs create a nearly or fully 180-degree back-thigh angle, reducing or virtually eliminating flexion forces in the lumbar spine.

Sit/stand desks allow the user to alternate between sitting and unsupported standing, allowing for periodic relief of the legs and lower back, respectively.

Each of these devices has disadvantages that the present disclosure does not.

Lumbar-support devices often do not apply enough pressure to the lumbar spine to maintain neutral curvature. They are often used ineffectually, such as when the user does not sit far enough back in the seat pan or when inadequate pressure is applied by the device to the lumbar spine.

Lumbar-support devices, saddle chairs, and kneeling chairs place the user in a fixed position and thus are not conducive to repositioning, which is necessary to redistribute stresses and pressure points, or to promote blood flow.

Saddle chairs put significant pressure on the ischial tuberosities ("sit bones") and the soft tissue near the sit bones, which can cause discomfort over time.

Kneeling chairs put significant pressure on the knees, which can cause discomfort over time.

Perching stools sometimes require stiff cushions to maintain grip between the user's butt and the seat, to prevent the user from sliding down the seat.

Saddle chairs, kneeling chairs, and perching stools require some core exertion to maintain neutral lumbar lordosis, though less exertion than required by a chair that places the thighs at 90 degrees in relation to the back. Kneeling chairs and perching stools also require leg-muscle exertion to prevent the butt from sliding down the seat.

Reclining chairs require flexion of the upper back or neck to maintain a horizontal head when viewing a screen. Reclining chairs also position the user farther from items on a desk, such as a keyboard, requiring him or her to reach when using such items. Reclining chairs also require a headrest to prevent the head from falling backward. Reclining chairs also make it difficult to read or write on a desk, activities that usually warrant an upright or forward lean of the upper body. Lastly, reclining chairs put the sitter in a more rested position, which can cause drowsiness and reduce attentiveness.

Perching stools and leaning chairs direct a high proportion of the body weight through the legs, stressing the musculature and joints in the legs.

Sit/stand desks require raising and lowering the desk platform, a function that can be expensive to implement and interrupts the user's activity every time the desk platform is translated.

Most methods of sitting, perching, and leaning keep the body symmetrical between the right and left halves. In particular, the back-thigh angle of the right leg is the same as that of the left. However, this need not be the case. For example, U.S. Pat. No. 8,220,872 describes a sitting device in which one leg is in a standing position (i.e. with a 180-degree femur-spine angle) and the other leg in a sitting position (i.e. with a 90-degree femur-spine angle), or in which both legs are in a sitting position. The device has a separate seat pad for each the left and right side which robotically changes angle such that the user can switch standing legs without repositioning the upper body. A disadvantage of this design is that it is complex and potentially expensive to manufacture.

An improved apparatus for sitting/standing satisfies several needs: It enables a 180-degree back-thigh angle; it does not cause extension or flexion of the cervical spine; it eliminates fatigue caused by continuous balancing; it allows periodic rest of leg extensor muscles and relief of pressure points; it allows for positional adjustment with minimal effort; and it is simple in construction.

BRIEF SUMMARY

The present disclosure promotes good posture by enabling the user to extend a leg downward while in a "half-seated" position, in which the user's posture is similar to that of a person who is standing.

The present disclosure vertically supports one side ("supported side") of the user's pelvis while the other side ("unsupported side") is vertically supported by the user's standing leg. Having one but not the other side of the pelvis supported by the seat is possible because there is a cutout in the seat through which the standing leg may extend. The seat underlies the sit bone on the supported side of the pelvis but does not underly the sit bone on the unsupported side of the pelvis. The foot on the supported side is placed on a footrest, while the foot on the unsupported side is placed on a base. The weight of the user is therefore distributed among the seat, the footrest, and the base. When the left sit bone but not the right sit bone is supported by the seat, the user is said to be in a "left-seated" position. When the right sit bone but not the left sit bone is supported by the seat, the user is said to be in a "right-seated" position. Stability of the user is enhanced when the user presses back on the seat with the unsupported side of the pelvis, engaging a built-in anti-rotation mechanism (e.g., a mechanical stop, a friction device, etc.) and preventing pelvic rotation in the transverse plane of the user's body. It can be readily inferred that the leg extensor muscles on the supported side are rested, while those on the unsupported side are engaged.

The user may at any time switch the supported and unsupported sides. To do so, the user need only reorient the seat so that the seat underlies the newly supported side and no longer underlies the previously supported side. Therefore, the present disclosure features a seating apparatus that allows for a simple and minimally disruptive way to switch supported and unsupported sides of the pelvis. Reorientation can be rotation, translation, or a combination of the two.

Besides the "left-seated" and "right-seated" positions, the user has other choices of positions: The user may choose a standing position, in which neither sit bones are supported by the seat; the user may choose a conventionally seated position, in which both sit bones are resting on the seat and both feet are resting on a footrest, the base, or the floor; the user may switch to a seated position in which he or she is straddling a saddle integrated into the seat, with both feet on a base or the floor.

BRIEF DESCRIPTION OF THE DRAWING

FIG. 1 is an isometric view of a half-sitting stool, consistent with embodiments of the present disclosure.

FIGS. 2A-2C are isometric views of a half-sitting stool with a person in various seated positions, consistent with embodiments of the present disclosure.

DETAILED DESCRIPTION

Figure 3:
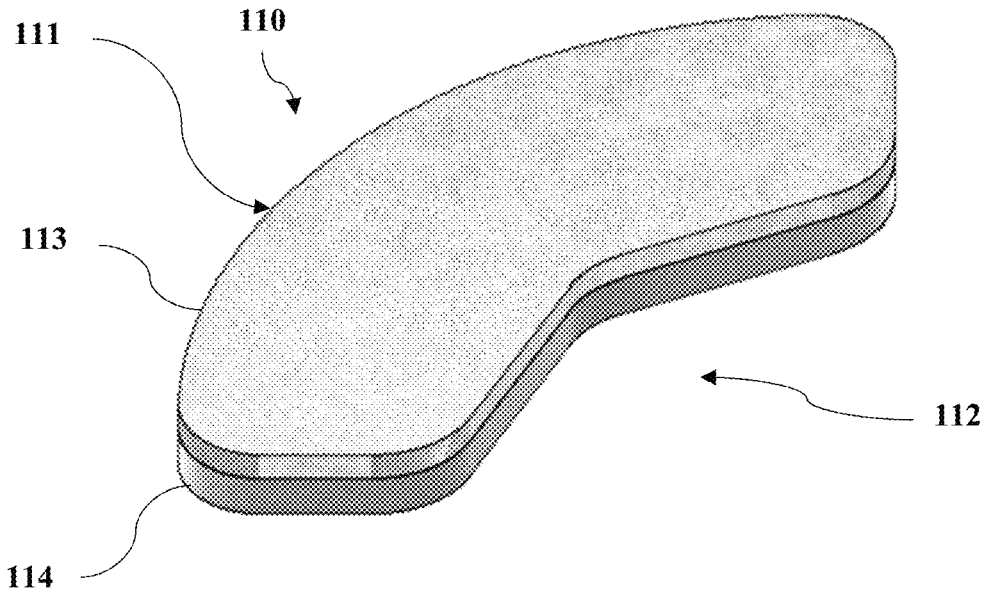
FIG. 3 is an isometric view of the seat platform of the half-sitting stool of FIG. 1, consistent with embodiments of the present disclosure.

FIG. 1 is an isometric view of a half-sitting stool, consistent with embodiments of the present disclosure.

The half-sitting stool 10 of the present disclosure includes a seat portion 100, supported by a stem portion 200, and a base portion 300 upon which stem portion 200 is mounted. The seat portion 100 can rotate relative to the base portion 300 in the transverse plane of the user. An apparatus enabling orientation of seat portion 100 relative to base portion 300 may be located in seat portion 100, stem portion 200, or base portion 300. The distance between seat portion 100 and base portion 300 can be adjusted by a height-adjustment mechanism. Also shown in FIG. 1 is a footrest portion 400 that, in some embodiments, is attached to the base portion 300 and, in other embodiments, is separate from base portion 300.

Stem portion 200 is attached to base portion 300 so that stem portion 200 remains upright and does not tip over, even when a leaning force is applied to it. The base portion 300 may be an apparatus movable relative to the floor, affixed to the floor, or contained in the floor.

FIGS. 2A-2C are isometric views of a half-sitting stool with a user in various seated positions, consistent with embodiments of the present disclosure. FIGS. 2A-2C show a general embodiment of the present disclosure with a user 900 in three positions:

FIG. 2A shows the user in a left-seated position;

FIG. 2B shows the user in a right-seated position;

FIG. 2C shows the user in a conventionally seated position.

FIGS. 2A-2C illustrate several positions available to the user with minimal effort required to configure the apparatus for the desired position and with minimal transverse movement of the user's torso. It can be seen from FIG. 2A and FIG. 2B that a pseudo-standing posture is possible while simultaneously being supported by the seat. In FIG. 2C, the user assumes a sitting posture because the user is in a conventionally seated position.

To rotate the seat, the user can manually use his/her hands. Alternatively, the user can lower the leg on the supported side, applying backward pressure on the edge of seat 100, thereby inducing a transverse torque on seat 100 that causes it to rotate, while simultaneously raising the leg on the unsupported side, until the seat underlies the pelvis on the previously unsupported side, which becomes the supported side.

In some embodiments, the half-sitting stool may contain a rotational spring which tends to return seat 100 to a default position (e.g., bias the seat 100 to a default position, etc.), in addition to or in lieu of an anti-rotation mechanism. Multiple default positions are possible (e.g., a center default position, a left default position, a right default position, etc.)

Although the user of FIGS. 2A-2C is shown with an unsupported leg at approximately 180 degrees in relation to the user's torso, the user may have the unsupported leg at less than 180 degrees in relation to the user's torso, in which case the user could be said to be in a leaning position, but the operating principles of the half-sitting stool remain the same.

FIG. 3 is an isometric view of the seat platform of the half-sitting stool of FIG. 1, consistent with embodiments of the present disclosure. FIG. 3 shows an embodiment 110 of seat portion 100 comprising a seat platform 111 and a cutout 112. Seat platform 111 vertically supports the user beneath one, the other, both, or neither of the user's ischial tuberosities (i.e., "sit bones", left ischial tuberosity, right ischial tuberosity, etc.). Cutout 112 is an empty space (i.e., a void, an opening, etc.) of seat portion 110 that permits extension of one of the user's legs on the unsupported side downward through cutout 112. The seat platform 111 includes a seat base 114 that provides structural support to seat portion 110 and a seat cushion 113 that distributes pressure applied to the user's buttocks and thereby provides comfort.

The seat platform can have various shapes (when viewed from the top) to accommodate different sizes of people (e.g., a smaller size for smaller adults/kids, a larger size for larger adults/kids, etc.). The specific profile of the seat platform can also be varied. For example, the empty space can have a larger or smaller angle, the size of the saddle portion can be longer/shorter, or wider/narrower.

The 3-D profile of the seat platform (when viewed from the side) can also vary. In the embodiments shown here, the 3-D profile of the seat platform is flat. The 3-D profile of the seat platform can be varied by using different shapes/contours of the seat base and/or the seat cushion.

Figure 4A:
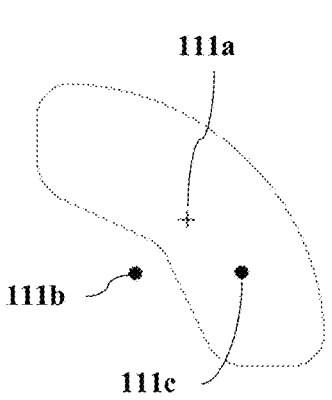
FIGS. 4A-4C are top views of three orientational positions of the seat platform of FIGS. 1 and 3, consistent with embodiments of the present disclosure.
Figure 4B:
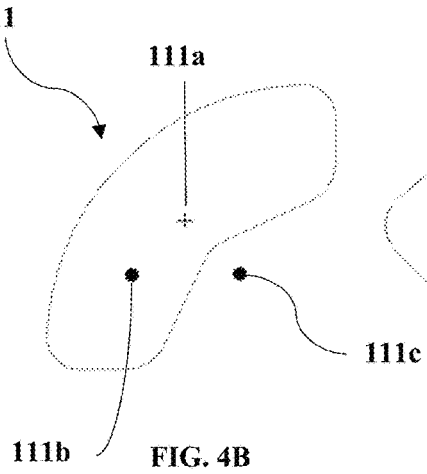
Figure 4C:
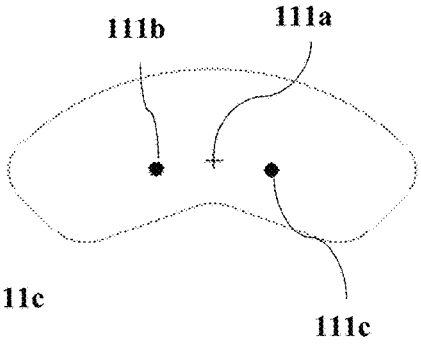

FIGS. 4A-4C are top views of three orientational positions of the seat platform of FIGS. 1 and 3, consistent with embodiments of the present disclosure. FIGS. 4A-4C show seat platform 111 from a top view in three orientational positions of seat platform 111 corresponding to the three seated positions shown in FIGS. 2A-2C. The location of the user's right sit bone 111*b*, the user's left sit bone 111*c*, and the axis of rotation 111*a* are shown for reference. In the preferred embodiment, the axis of rotation 111*a* is stationary, but in other embodiments the axis may move as the seat is rotated. FIG. 4A corresponds to the left-seated position, in which the left sit bone of the user is underlain and supported by seat platform 111 while the left sit bone is not; FIG. 4B corresponds to the right-seated position, in which the right sit bone of the user is underlain and supported by the seat platform 111 while the left sit bone is not; FIG. 4C corresponds to the conventionally seated position, in which both the left and the right sit bones are supported by the seat platform 111. In the left-seated and right-seated positions, the user's sit bones are approximately in the same position. Although seat platform 111 is flat in the embodiment shown, it can also be shaped, sculpted, molded, or contoured in various shapes for aesthetic, ergonomic, or comfort purposes without change in the function of the apparatus.

Although the changes in orientation of the seat shown in FIGS. 4A-4C are purely rotational, in other embodiments the seat may be translatable in the transverse plane of the user, in which case axis of rotation 111*a* is not stationary and may move up and down or left and right as viewed from above. The function of seat translation may be implemented using a linear slide mechanism, for example. The purpose of enabling seat translation in addition to rotation may be to enhance adjustability of the seat position or to make such adjustment easier to execute.

Figure 5A:
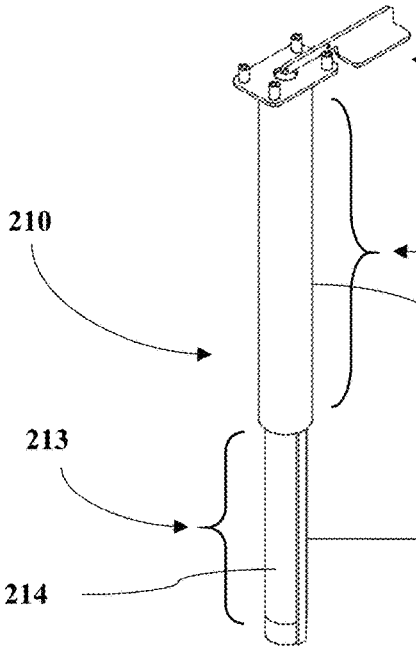
FIGS. 5A-5B are isometric view of a stem portion of the half-sitting stool of FIG. 1, consistent with embodiments of the present disclosure.
Figure 5B:
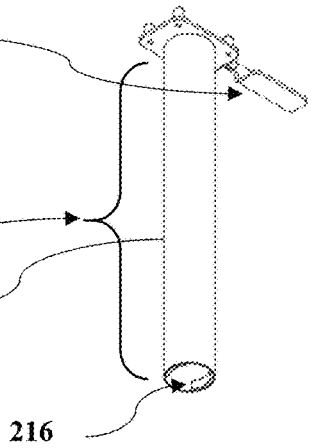

FIGS. 5A-5B are isometric views of a stem portion of the half-sitting stool of FIG. 1, consistent with embodiments of the present disclosure. FIGS. 5A and 5B show an embodiment 210 of stem portion 200 comprising upper column 212 and lower column 213. In this embodiment, upper column 212 and lower column 213 are telescopically movable relative to each other so that the height of seat portion 100, which is attached to one of the two columns, can be adjusted relative to the base portion 300, which is attached to the other column. The columns are cylindrical and concentric. In various other embodiments, the columns may be non-concentric or have non-round cross sections. Alternative embodiments may include a plurality of columns. In other embodiments still, the apparatus implementing height adjustment may consist of linkages rather than telescoping columns. In any case, the resultant adjustability of height is necessary to accommodate people of various inseam lengths and to accommodate the user's preferred seat height.

Upper column 212 can include a height-adjustment lever 211, an outer cylinder 217, and a bushing 216. The lower column 213 can include a gas lift 214 and a guide rail 215. The column length is fixed until the user activates the height-adjustment mechanism by actuating height-adjustment lever 211 which in turn actuates a pushbutton on gas lift 214, permitting gas lift 214 to extend or retract. Bushing 216 serves as a linear bushing between outer cylinder 217 and gas lift 214. Bushing 216 also is used to implement a rotation-limiting function in conjunction with guide rail 215.

Figure 6:
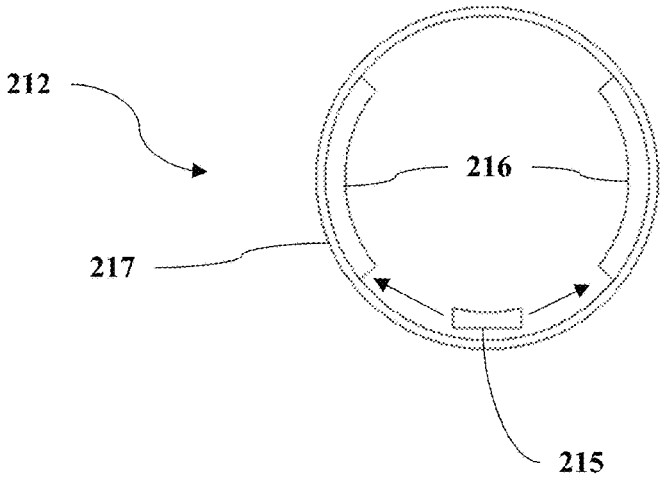
FIG. 6 is a cross-sectional view of a portion of an upper column of the stem portion of FIGS. 5A-5B, consistent with embodiments of the present disclosure.

FIG. 6 is a cross-sectional view of a portion of an upper column of the stem portion of FIGS. 5A-5B, consistent with embodiments of the present disclosure. FIG. 6 shows a portion of upper column 212 from a cross-sectional bottom view. Bushing 216 is rigidly attached to outer cylinder 217, while guide rail 215 is rigidly attached to gas lift 214 (not shown in FIG. 6). When upper column 212 rotates in either direction, bushing 216 can eventually contacts guide rail 215, preventing further rotation. Since upper column 212 rotates in conjunction with seat portion 100 and lower column 213 remains fixed relative to base portion 300, rotation of seat portion 100 relative to base portion 300 is constrained to a predetermined range. Therefore, when the user is in the left-seated or right-seated position, any tendency for the user's hip to rotate clockwise (as viewed from above) in the former case and counterclockwise in the latter case is restrained, thereby minimizing the need for the user to actively maintain forward hip direction using core and leg muscles. This rotation-limiting function also allows the user to apply a slight backward lean to further promote stability. In other embodiments, the half-sitting stool 10 may have no anti-rotation mechanism, in which case the disclosure nevertheless supports the pelvis vertically but does not necessarily support the pelvis rotationally.

Figure 7A:
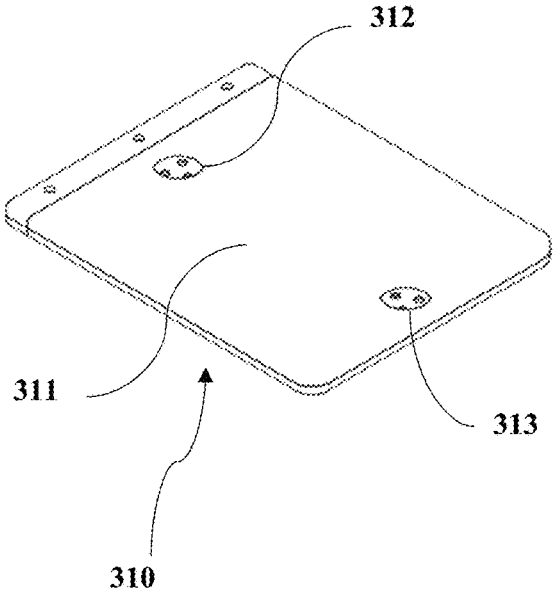
FIGS. 7A-7B are isometric view of different base portions for use with a half-sitting stool, consistent with embodiments of the present disclosure.
Figure 7B:
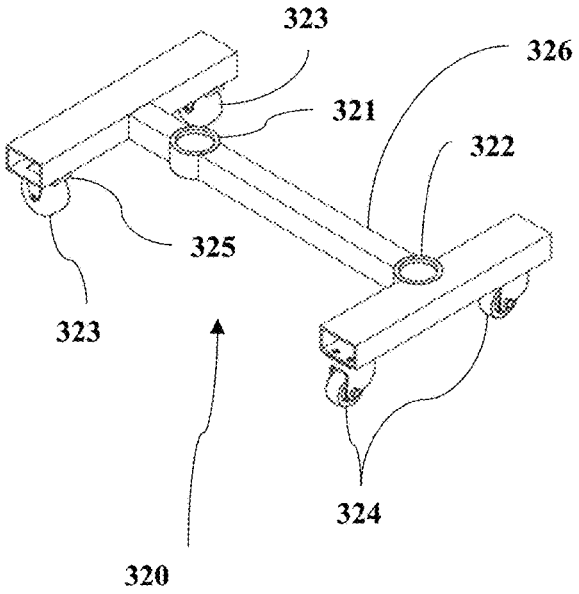

FIGS. 7A-7B are isometric views of different base portions for use with a half-sitting stool, consistent with embodiments of the present disclosure.

Base portion 300 serves as a support for stem portion 200 and footrest portion 400. Base portion 300 (not shown in FIGS. 7A-7B; see FIG. 1) also serves to prevent lateral movement of half-sitting stool 10 relative to the floor. FIGS. 7A and 7B show two embodiments of base portion 300.

Embodiment 310 of base portion 300 (see FIG. 1) includes a standing surface 311, a mount point 312 for stem portion 200, and a mount point 313 for footrest portion 400. In the left-seated and right-seated positions, the user's foot on the unsupported leg rests on standing surface 311, while the user's foot on the supported leg rests on footrest portion 400. In the standing position, both of the user's feet rest on standing surface 311. In the conventionally seated position, the user's feet rest on footrest portion 400. Base portion 310 may be contained in the floor. Base portion 310 may also be the floor itself, in which case stem portion 200 and footrest portion 400 are mounted to the floor.

Embodiment 320 of base portion 300 includes a structural frame 326 that is offset from the floor by a plurality of wheels. Front wheels 324 are swiveling and rear wheels 323 non-swiveling. The wheels are mounted to structural frame 326. Structural frame 326 includes mount point 321 for stem portion 200 and mount point 322 for footrest portion 400. In the left-seated and right-seated positions, the user's foot on the unsupported side rests on the floor beside structural frame 326. In the standing position, both the user's feet rest on the floor beside structural frame 326. Embodiment 320 also includes a brake 325 that prevents the wheel from spinning when the user applies some weight to half-sitting stool 10 via seat portion 100. The function of brake 325 is to prevent transverse movement of half-sitting stool 10 relative to the floor while the user has some of her weight applied to half-sitting stool 10.

Figure 8:
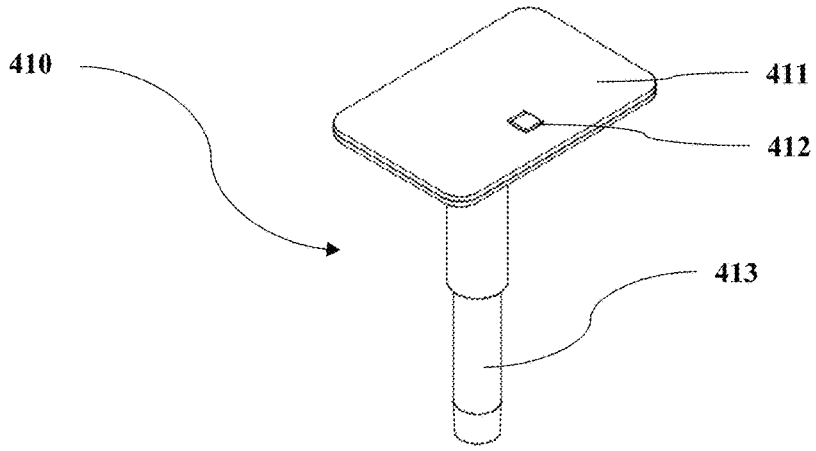
FIG. 8 is an isometric view of a footrest portion for use with a half-sitting stool, consistent with embodiments of the present disclosure.

FIG. 8 is an isometric view of a footrest portion for use with a half-sitting stool, consistent with embodiments of the present disclosure. FIG. 8 shows an embodiment 410 of footrest portion 400 (not shown in FIG. 8; see FIG. 1). Footrest portion 410 includes a footrest platform 411, a pushbutton 412, and a column 413. In the left-seated position, the user's left foot is on footrest platform 411. In a right-seated position, the user's right foot is on footrest platform 411. In a conventionally seated position, both the user's feet are on footrest platform 411. Column 413 is attached to the base portion 300 and supports the footrest platform 411. Column 413 includes a gas lift that can extend and retract to adjust the height of footrest platform 411 relative to base portion 300. The user raises footrest platform 411 by pressing pushbutton 412 with her foot while simultaneously lifting her same foot. The user lowers footrest platform 411 by pressing pushbutton 412 with her foot while simultaneously pressing down on footrest platform 411. It can be seen that raising and lowering footrest platform 411 can be done easily with just one foot.

Figures 9A, 9B, 9C:
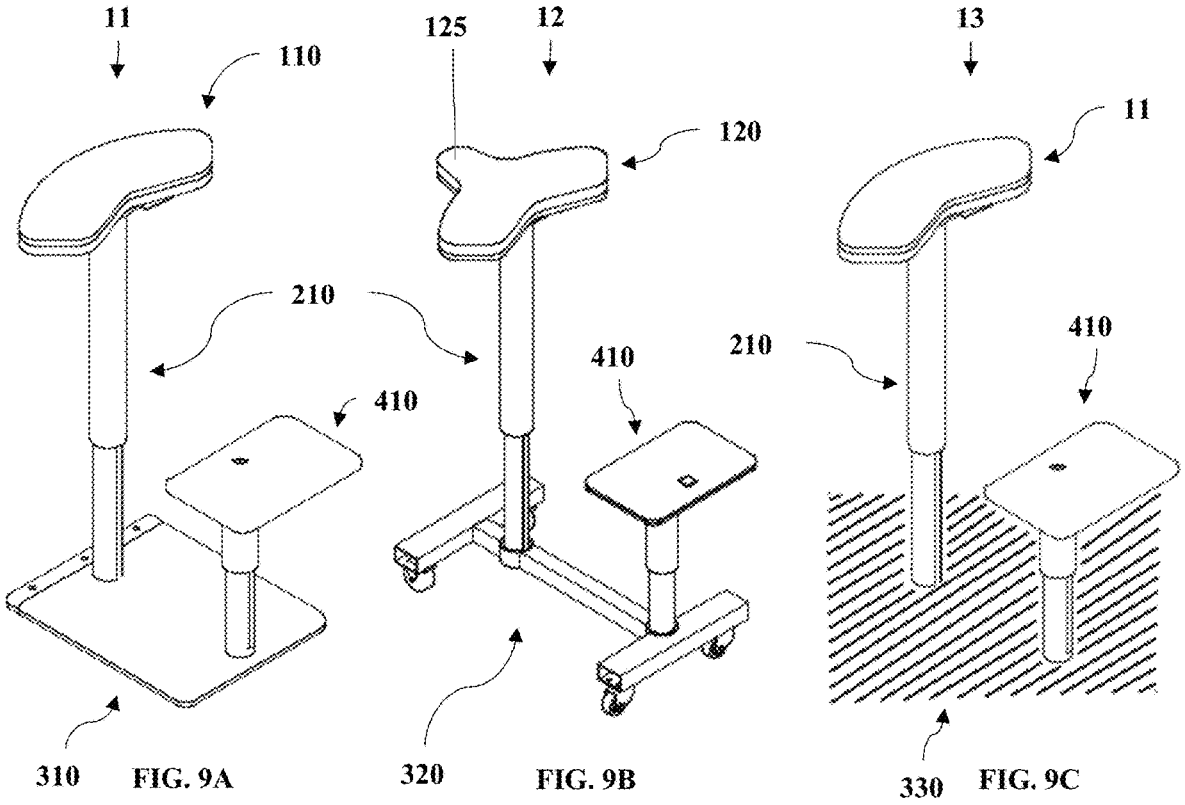
FIGS. 9A-9C are isometric views of different embodiments of the half-sitting stool, consistent with embodiments of the present disclosure.

FIGS. 9A-9C are isometric views of different embodiments of the half-sitting stool, consistent with embodiments of the present disclosure. To illustrate some of the possible combinations of seat, stem, base, and footrest, FIGS. 9A-9C show three embodiments of half-sitting stool 10. Embodiments 11 and 13 include seat portion 110, while embodiment 12 includes embodiment 120 of seat portion 100. Seat portion 120 includes all the elements of seat portion 110 but also includes a saddle 125 on which the user can sit in when saddle 125 is pointed forward. All three embodiments include stem portion 210 and footrest portion 410. Half-sitting stool 11 includes base portion 310; half-sitting stool 12 includes base portion 320; and half-sitting stool 13 includes embodiment 330 of base portion 300. Base portion 330 is a floor with mounting points for stem portion 200 and footrest portion 410. FIGS. 9A-9C are meant to provide some examples of combinations of seat, stem, base, and footrest, but it is not practical to show every possible combination here. FIG. 9C shows an embodiment where there is no separate base—the base is the floor.

What is claimed is:

1. A seating apparatus for supporting a portion of a user, the seating apparatus comprising:

a base portion;

a reorientable seat portion including a seat platform and a cutout, wherein the seat selectively portion is configured and arranged to underly a first ischial tuberosity of the user but not the second ischial tuberosity, the selection of which is determined by the orientation of the reorientable seat portion; and a rotation-limiting apparatus configured and arranged to inhibit the rotation of the reorientable seat portion relative to the base portion.

2. The seating apparatus of claim 1, further comprising a stem portion connected to the reorientable seat portion and the base portion, the stem portion including a height-adjustment mechanism configured to selectively adjust the height of the reorientable seat portion relative to the base portion.

3. The seating apparatus of claim 1, The seating apparatus of claim 1, wherein the seat platform of the reorientable seat portion includes a saddle.

4. The seating apparatus of claim 1, wherein the base portion includes a standing surface.

5. The seating apparatus of claim 1, wherein the seat platform is configured and arranged to be rotatable about a vertical axis.

6. The seating apparatus of claim 1, wherein the seat platform is configured and arranged to be reorientable along a transverse plan relative to a user.

7. The seating apparatus of claim 6, wherein a first two of the plurality of wheels may swivel and a second two of the plurality of wheels may not swivel.

8. The seating apparatus of claim 1, wherein the base portion includes a footrest.

9. The seating apparatus of claim 8, wherein the base portion includes a braking apparatus wherein the rotation of one of the plurality of wheels opposite the footrest may be inhibited, the braking apparatus being activated by the user by applying weight to the seating apparatus.

10. A seating apparatus for supporting a portion of a user, the seating apparatus comprising:

a rotatable seat portion including a seat platform and a cutout, wherein the seat platform selectively underlies a first or second ischial tuberosity of the user, the selection of which is determined by an orientation of the rotatable seat portion;

a base portion;

a stem portion connected to the rotatable seat portion and the base portion, the stem portion including a height-adjustment mechanism configured to selectively adjust the height of the rotatable seat portion relative to the base portion; and rotation-limiting apparatus configured and arranged to inhibit the rotation of the seat portion relative to the base portion.

11. The seating apparatus of claim 10, wherein the seat platform of the rotatable seat portion includes a saddle.

12. The seating apparatus of claim 10, wherein the base portion includes a standing surface.

13. The seating apparatus of claim 12, wherein the base portion includes a footrest.

14. The seating apparatus of claim 10, wherein the base portion includes a plurality of wheels.

15. The seating apparatus of claim 14, wherein the base portion includes a footrest.

16. The seating apparatus of claim 15, wherein the base portion includes a braking apparatus wherein the rotation of a wheel may be inhibited, the braking apparatus being activated by the user by applying weight to the seating apparatus.

17. The seating apparatus of claim 14, wherein two of the wheels may swivel and two may not swivel.

18. A seating apparatus for supporting a portion of a user, the seating apparatus comprising:

a base portion a rotatable and translatable seat portion including a seat platform and a cutout configured and arranged to interact with the user in a first configuration or a second configuration, and where the first configuration includes the seat platform selectively underlying a first ischial tuberosity of the user but not the second ischial tuberosity of the user, the selection of which is determined by a rotation angle of the rotatable and translatable seat portion and a translation position, and the second configuration includes the seat platform of the rotatable and translatable seat portion selectively underlying both of the user's ischial tuberosities; and a rotation-limiting apparatus configured and arranged to inhibit the rotation of the seat portion relative to the base portion.

* * * * *